US008575045B1

(12) United States Patent
McKnight et al.

(10) Patent No.: US 8,575,045 B1
(45) Date of Patent: Nov. 5, 2013

(54) FIBER MODIFIED WITH PARTICULATE THROUGH A COUPLING AGENT

(75) Inventors: Steven H. McKnight, Newark, DE (US); Robert E. Jensen, Newark, DE (US); Joshua A. Orlicki, Havre de Grace, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 2572 days.

(21) Appl. No.: 11/134,287

(22) Filed: May 23, 2005

Related U.S. Application Data

(60) Provisional application No. 60/578,472, filed on Jun. 10, 2004.

(51) Int. Cl.
*B32B 27/04* (2006.01)
*D02G 3/00* (2006.01)

(52) U.S. Cl.
USPC ..... 442/134; 428/372; 428/375; 428/394; 428/395; 428/391; 442/135

(58) Field of Classification Search
None
See application file for complete search history.

(56) References Cited

U.S. PATENT DOCUMENTS 2,885,308 A * 5/1959 Healy, Jr. ..... 428/372
4,267,285 A * 5/1981 Broutman ..... 525/145
4,328,324 A 5/1982 Kock et al.
4,357,387 A 11/1982 George et al.
4,400,424 A * 8/1983 Hatada et al. ..... 428/212
4,410,586 A * 10/1983 Ladizesky et al. ..... 442/334
4,467,013 A 8/1984 Baldwin
4,469,746 A 9/1984 Weisman et al.
4,469,748 A 9/1984 Sharma
4,997,704 A 3/1991 Jarrabet
5,002,582 A 3/1991 Guire et al.
5,200,263 A 4/1993 Gould et al.
5,328,765 A * 7/1994 Anderson et al. ..... 428/364
5,352,480 A * 10/1994 Hansen et al. ..... 427/202

(Continued)

FOREIGN PATENT DOCUMENTS

EP 0 332 919 A2 9/1989
JP 02191768 A * 7/1990

(Continued)

OTHER PUBLICATIONS

Pappas et al., "Wettability of Nylon Fibers Modified via Atmospheric Plasma Treatment and Surface Roughness" 2006.

*Primary Examiner* — Jill Gray
(74) *Attorney, Agent, or Firm* — William V. Adams; Christos S. Kryiakou

(57) ABSTRACT

An article is provided that includes a polymeric fiber that has an excess number of surface active reactive moieties relative to the number of surface reactive moieties found on the fiber in a native state. A particle is bonded covalently to the fiber through an intermediate coupling agent. Multiple particles can be covalently bonded to the fiber, the multiple particles can be bonded uniformly or asymmetrically around the fiber diameter. A process for modifying a fiber includes creating surface activated reactive moieties thereon. The activated fiber is then exposed to a liquid solution containing a coupling agent to form a covalent bond. The coupling agent is also reacted with a particle in a liquid solution to form a covalent bond between the coupling agent and the particle. The coupling agent is covalently bonded to either a particle and then bonded to the fiber, or vice versa.

30 Claims, 3 Drawing Sheets

(56) References Cited

U.S. PATENT DOCUMENTS

| | | | | |
|---|---|---|---|---|
| 5,411,638 | A | 5/1995 | Bernard et al. | |
| 5,432,000 | A * | 7/1995 | Young et al. | 428/372 |
| 5,523,156 | A * | 6/1996 | Anderson et al. | 428/395 |
| 5,562,988 | A * | 10/1996 | Anderson et al. | 428/395 |
| 5,728,432 | A * | 3/1998 | Imashiro et al. | 427/389.8 |
| 5,880,042 | A | 3/1999 | Schuster et al. | |
| 6,127,029 | A * | 10/2000 | Imashiro et al. | 428/300.1 |
| 6,242,041 | B1 | 6/2001 | Katoot et al. | |
| 6,593,255 | B1 * | 7/2003 | Lawton et al. | 442/59 |
| 6,607,994 | B2 * | 8/2003 | Soane et al. | 442/59 |
| 6,770,576 | B2 | 8/2004 | Cook et al. | |
| 6,916,402 | B2 * | 7/2005 | Shannon et al. | 162/9 |
| 6,955,844 | B2 * | 10/2005 | Tagge et al. | 428/53 |
| 7,332,196 | B2 * | 2/2008 | Kosuge et al. | 427/387 |
| 2002/0160159 | A1 | 10/2002 | McDonald et al. | |
| 2003/0013369 | A1 * | 1/2003 | Soane et al. | 442/181 |
| 2004/0137812 | A1 | 7/2004 | Suzuki et al. | |
| 2008/0107901 | A1 * | 5/2008 | Kosuge et al. | 428/391 |

FOREIGN PATENT DOCUMENTS

| | | | |
|---|---|---|---|
| JP | 04146279 | A | 5/1992 |
| JP | 06116862 | A | 4/1994 |
| JP | 10140420 | A | 5/1998 |
| JP | 200017568 | A | 1/2000 |
| JP | 2001131863 | A | 5/2001 |
| WO | WO 0106054 | A1 * | 1/2001 |
| WO | WO 02084017 | A1 * | 10/2002 |

* cited by examiner

FIBER MODIFIED WITH PARTICULATE THROUGH A COUPLING AGENT

RELATED APPLICATION

This application claims priority of U.S. Provisional Patent Application Ser. No. 60/578,472 filed Jun. 10, 2004, which is incorporated herein by reference.

GOVERNMENT INTEREST

The invention described herein may be manufactured, used, and licensed by or for the United States Government.

FIELD OF THE INVENTION

The present invention relates in general to a fiber having a modified surface and in particular to a fiber surface modified with particulate in order to enhance fiber physical properties.

BACKGROUND OF THE INVENTION

The barrier characteristics of a material are profoundly affected by the surface properties of the material. While synthetic fibers allow considerable control as to polymeric chain composition, the ability to modify surface properties of a synthetic fiber is somewhat limited. While organic or silicone-based agents can be applied to a synthetic fiber surface in order to modify the hydrophobicity of the surface, such coatings are temporary and such are unsuitable for high performance applications. Polymeric fibers woven to form fabrics, unwoven mats and chopped fibers have numerous applications including clothing, resin composites, ballistic-resistant structures, protective housings and skins, and medical implants. With the ability to modify surface properties of synthetic polymeric fibers, a variety of performance characteristics of a resulting article containing such fibers could be tailored to end user specifications.

Previous attempts to modify synthetic polymer fiber surfaces through particulate adhesion have typically involved plasma or corona discharge of the fiber surface, followed by exposure to colloidal particulate such as colloidal silica with reliance on ionic and van der Waals interactions to adhere the colloidal particulate to the fiber surface. Alternatively, particulate is applied through direct plasma spraying onto the surface of a synthetic polymeric fiber. Still another variation is placing the synthetic fiber in a solution containing grafting polymer initiator and a graftable polymer followed by exposure to an energy source to induce graft polymerization. These techniques have met with limited acceptance owing to irregular particulate application to the fiber surface, process complexity, and the propensity of adhered particles to exfoliate.

In the case of natural fibers, cupro-ammonium rayon acetate, and polyester fibers, ceramic particulate is chemically bonded to these fibers through a silane coupling agent as detailed in JP 06-116862. However, the ability to covalently bond a coupling agent to a synthetic fiber is limited to a covalent bonding between the coupling agent and the ceramic particle followed by coupling to an existing reactive group within the fiber. As such, this process is limited only to fibers having an existing number of surface reactive groups sufficient to achieve the desired modification.

Thus, there exists a need for a synthetic fiber having an activated surface that covalently bonds to a surface modifying particulate through a coupling agent and a process for producing the same.

SUMMARY OF THE INVENTION

An article is provided that includes a polymeric fiber that has an excess number of surface active reactive moieties relative to the number of surface reactive moieties found on the polymeric fiber in a native state. A particle is bonded covalently to the polymeric fiber through an intermediate coupling agent. The coupling agent being at least bi-functional and forming a covalent bond with one of the surface activated reactive moieties and a second covalent bond with the particle. Additional substances are optionally bonded to the particle. In instances when multiple particles are covalently bonded to the polymeric fiber, the multiple particles are bonded uniformly or asymmetrically about a polymer fiber diameter.

A process for modifying a fiber includes activating the polymeric fiber to create numerous surface activated reactive moieties thereon. The polymer fiber having an activated surface is then exposed to a liquid solution containing a coupling agent. The polymeric fiber is then allowed to react with the coupling agent to form a covalent bond. The coupling agent is also exposed to multiple particles in a liquid solution under conditions facilitating formation of a covalent bond between the coupling agent and at least one of the multiple particles. The coupling agent is covalently bonded to either a particle and then bonded to the fiber or vice versa. Through the use of liquid phase combination of polymeric fiber, coupling agent and particles, considerable control is exerted over the fiber modification process. Fiber activation in the presence of a reactive gaseous atmosphere is particularly well suited to form the surface activated reactive moieties.

DETAILED DESCRIPTION OF THE PREFERRED EMBODIMENTS

Figure 1:
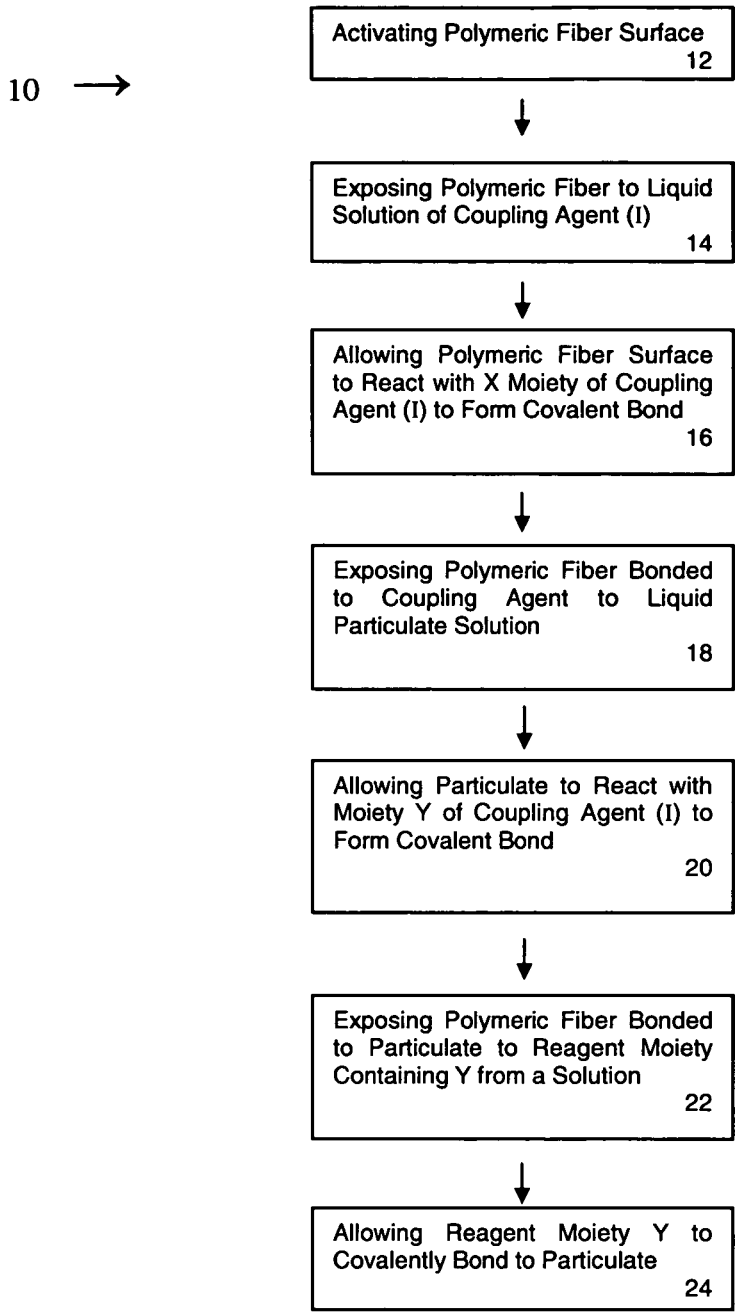
FIG. 1 is a flowchart of a representative process for preparing an inventive article through plasma activation of a synthetic polymeric fiber.

The present invention has utility as a fiber and process for producing the same with tunable surface properties through covalent bonding of particulate thereto. Representative manifestations of the present invention include increasing the strength of ballistic fibers, strength improvements in fiber containing resin composites, creation of catalytically active garments, and spectroscopically identifiable articles. Through covalently bonding surface modifying particulate to a polymeric fiber, the fiber is further modified through bonds created between the particle and other substances remote from the fiber.

An inventive process includes activating the polymer fiber surface to create reactive moieties reactive with a coupling agent so as to form a covalent bond. A coupling agent is also covalently bonded to a surface modifying particle. The fiber particle activation occurring through conventional techniques such as plasma discharge, actinic irradiation, X-ray radiation and the like. The activated fiber surface is then exposed to wet chemistry solutions of coupling agent in succession with particulate or coupling agent already covalently bonded to the particulate. Following reaction to covalently adhere the particulate to the fiber surface, fibers are optionally processed to further modify the particulate or otherwise processed, as are conventional fibers to form articles, or components thereof. While the subsequent description pertains to the surface modification of a synthetic polymeric fiber, it is appreciated that the present invention is equally well suited to the treatment of fabrics, unwoven mats, as well as fiber aggregates containing such a fiber.

A fibrous article made according to the present invention includes a polymeric fiber amenable to activation so as to create reactive moieties on the fiber surface. Preferably, the polymeric fiber is synthetic. Synthetic polymeric fibers operative herein illustratively include aromatic polyamides (commercially available under the trade name KEVLAR®); alkyl polyamides, such as nylons; aralkyl polyamides, polyolefins such as polyethylene and polypropylene; polyesters such as polyethylene terephthalate (PET); block copolymers having blocks such as styrene, butadiene, ethylene or vinyl chloride; styrene butadiene copolymers, mixed olefin copolymers, polycarbonates, polystyrene, fluoropolymers such as polyvinylidene fluoride (PVDF), polytetrafluoroethylene (PTFE), polyperfluoroethylene propylene (FEP); polyvinyls such as polyvinyl chloride; polyurethanes such as polyurethane polyester; polysiloxanes; polycarbonate/polydimethyl siloxane copolymers; poly p(-phenylenebenzobisoxazole) (PBO); polyimides and related materials, such as polyetherimides; and carbon fibers. In the majority of situations where an article benefits from the present invention, a synthetic polymeric fiber lacks sufficient reactive surface moieties to afford desired particle coating coverage and as such, surface activation of that synthetic polymeric fiber is preferred. Natural fibers amenable to surface activation and coupling of particulate according to the present invention illustratively include silk, cellulose, wool, cotton, linen, hemp, ramie, and jute. While it is appreciated that the nature of the surface activated reactive moiety capable of covalent bonding to a coupling agent depends on whether the linkage formed to the coupling agent is through an electrophilic, or nucleophilic reaction mechanism. Suitable surface reactive moieties include heteroatom sites of nitrogen, sulfur, and oxygen, present as a neutral group, ion or radical, an ylide, an aromatic radical; a vinyl; an azide; an alkenyl; a halide; or a silyl. It is further appreciated that several types of surface reactive moieties so formed on a single fiber are capable of reacting with coupling agent brought into contact with the fiber surface. It is also accepted that sites of unsaturation also provide sites of modification, through both radical and nucleophilic mechanisms.

A particle covalently bonded to the synthetic polymeric fiber surface is dictated in large part by the desired attribute associated with the resulting inventive article. Particle loading on a fiber approaches a monolayer in a highly activated fiber surface having more than 3% of the total surface sites being chemically active, with the size of the particle, the number of bonding moieties on a particle, and the length of the coupling agent being some of the factors relevant to the percentage of surface active sites needed to approach monolayer coverage. Particles operative herein typically have a size ranging from 2 to 1000 nanometers linear dimension along the long axis of the particle. Preferably, the maximal linear dimension of particles used herein is between 4 and 100 nanometers. Particle shapes illustratively include spherical, oblate, prolate, cylindrical, conical, and combinations thereof. It is also appreciated that a particle optionally has a passivating ligand coating the particle. The exposed terminus of the passivating ligand optionally includes a reactive moiety capable of forming a covalent bond with the inventive coupling agent. Such a ligand passivated particle is intended to fall within the definition of a particle operative in the present invention. Particles operative herein illustratively include colloidal silica; silica alumina; silica magnesia; magnesium silicate; magnetic cobalt containing alloys; magnetic niobium containing alloys; metal-oxides, -sulfides, -carbides, -nitrides, -arsenides, -phosphides, such as $TiO_2$, ZnO, $WO_3$, $SnO_2$, $CaTiO_3$, $Fe_2O_3$, $MoO_3$, $Nb_2O_5$, $Ti_xZr_{(1-x)}O_2$, SiC, $SrTiO_3$, CdS, $CdSe_xTe_{1-x}$, CdSe, GaP, InP, GaAs, $BaTiO_3$, $KNbO_3$, $Ta_2O_5$, $Bi_2O_3$, NiO, $Cu_2O$, $SiO_2$, $MoS_2$, InPb, $RuO_2$, $CeO_2$, Ti $(OH)_4$, TiN; silicon; nanolatex; epoxidized rubber; polystyrene nanospheres; and barium strontium titanate (Ba, Sr)$TiO_3$.

As the number of active surface sites on the polymer fiber is inadequate in a native state to adequately coat the fiber with particulate, the polymer fiber surface is activated. Surface activation is achieved through a variety of methods to create dangling bonds or incorporate reactive moieties into the fiber surface. These moieties illustratively include oxygen radicals, hydroxyl, amine, azide, vinylics, acetylenics, isocyanates, silyls and halogens. A variety of techniques are conventional to the art for surface activation. A brief description of some of these conventional techniques follows.

Electron bombardment involves the direction of a beam or "cloud" of electrons onto a plastic surface to interact with the surface. The free electrons in the cloud or beam act to knock existing electrons out of their orbital positions in the polymer molecules, creating locations on the surface where other chemicals may bond. The electron beam may also cross-link or scission polymer chains, creating additional locations for chemical bonding. This process is carried out in a vacuum, air, oxygen, ammonia, chlorine gas, nitrogen, argon, nitrous oxide, helium, carbon dioxide, water vapor, $F_2$, $Br_2$, $CF_4$, $C_2H_2$, or methane.

Flame treatment involves the brief application of a flame or heat to the polymer surface to oxidize a thin surface layer of the material, creating highly active surface molecules. It is appreciated that many polymers have difficulty withstanding the addition of heat without deforming or changing in clarity or physical structure. If excessive heat is applied, the polymer fiber may soften or warp. Excess heat may also cause accelerated aging by the introduction of heat history to the material. Consequently, when the added heat is kept below a level that prevents these problems, the polymer frequently will not obtain sufficiently increased surface energy to adequately promote bonding. Preferably, flame or heat treatment increases the surface energy in polyolefins and other polymers enough to promote bonding to a coupling agent, while limiting surface temperature increase to below a level that will deform or significantly damage the material.

A preferred method of treating a polymer surface to create active surface sites is corona or plasma treatment. As used herein, the term "plasma" is defined to include a partially ionized gas composed of ions, electrons, and neutral species. A plasma operative herein is produced by strong electric arcs or electromagnetic fields. An electric arc plasma may be produced by a pair of electrodes spaced some suitable distance, facing each other. The electrodes are then given a high voltage charge (AC or DC), which causes electricity to arc across the gap between the electrodes. The distance between the electrodes primarily depends upon the voltage used. This high energy electric arc produces a plasma in the region immediately around the electric arc. An atmosphere of air, oxygen, ammonia, chlorine gas, nitrogen, argon, nitrous oxide, helium, carbon dioxide, water vapor, $F_2$, $Br_2$, $CF_4$, $C_2H_2$, or methane gas is appreciated to facilitate the creation of active sites. The nature of a coupling agent bonding moiety and the groups found within the polymer fiber being important factors in determining the nature of the plasma atmosphere.

When a polymer surface is exposed to a high energy plasma produced by a high voltage electric arc, the plasma interacts with the surface molecules, increasing their energy through a variety of mechanisms, depending on the specific polymer involved. In some cases, surface hydrogen molecules are removed, leaving behind active bonding sites, the identity of which are determined by the choice of plasma. Also, cross-linking or scission can occur in the surface molecules, as in electron bombardment. This will change the surface energy of the material, making it easier for a coating to adhere. Oxides may also form on the surface, as in flame treatment, which are easier to bond to than the actual base polymer. These are just a few of the possible chemical mechanisms which are caused by plasma treatment that increase surface energy. The great benefits of using electric arc plasmas are the relatively low temperature, and usage without damage to the surface of polymers and other relatively delicate materials.

With surface activation to increase the number of reactive surface sites, the polymer fiber surface is reacted with an inventive coupling agent having the formula $$(X)_m—R—(Y)_n \quad (I)$$

where X is independently in each occurrence a moiety reactive with an activated polymeric fiber surface

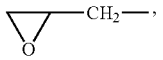

$NHR^1$—, HS—, HO—, $R^2OOC$—, $C(R^1)_2{=}CR^1$—, —$R^1C{=}CH—HC{=}CR^2$, OCN—, XOC— (X=Cl, Br, I), $R^1{\equiv}C$—, $N_3$—,

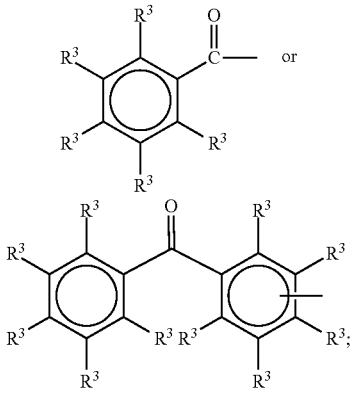

m is an integer 1, 2 or 3; $R^1$ is independently in each occurrence hydrogen or $C_1$-$C_4$ alkyl; $R^2$ is an electron, hydrogen, $C_1$-$C_4$ alkyl; $R^3$ is independently in each occurrence hydrogen; $C_0$-$C_4$ alkyl having a substituent from the group sulfonate, carboxyl, hydroxyl, amine, $C_1$-$C_4$ substituted amine, and quaternary amine; $C_6$-$C_{12}$ aryl; $C_7$-$C_{14}$ aralkyl; and two adjacent $R^3$ substituents combined to form a six-member ring joined to a base phenonyl group, the combined adjacent $R^3$ substituents having at least three cycloalkyl or aryl carbons and a fourth ring forming carbon, oxygen, sulfur or nitrogen atom or $NR^1$ group; R is a linear backbone of a $C_2$-$C_{24}$ alkyl, $C_6$-$C_{24}$ aryl, $C_6$-$C_{24}$ cycloalkyl, ethers-, esters-, thioethers- and amides- of $C_2$-$C_{24}$ alkyl, and solubility enhancing substituent of R where the substituent is sulfonyl; Y is $SiR_{3-p}{}^5$—$(OR^5)_p$, chlorosilyl, or X with the proviso that when Y is independently in each occurrence X, R is less than eight linear carbon atoms in the backbone to the nearest X; p is an integer 1, 2 or 3; $R^5$ is independently in each occurrence hydrogen and $C_1$-$C_4$ alkyl with the proviso that $R^5$ is not in all occurrences hydrogen; and m is an integer 1, 2 or 3.

In the inventive embodiment where the particulate is colloidal silica, it is preferred that the coupling agent be an alkoxy silane, where silane is reactive with the silica particulate and a polymer fiber surface reactive moiety is also provided. Preferred coupling agents for oxide rich particulate illustratively include: 3-aminopropyltrimethoxysilane, 3-aminopropyltriethoxysilane, 3-glycidoxypropyltrimethoxysilane, 3-glycidoxypropyltriethoxysilane, (3-glycidoxypropyl)bis(trimethylsiloxy)methylsilane, (3-glycidoxypropyl) methyldiethoxysilane, (3-glycidoxypropyl) dimethylethoxysilane, (3-glycidoxypropyl) methyldimethoxysilane, methacryloxymethyltriethoxysilane, methacryloxymethyltrimethoxysilane, methacryloxypropyldimethylethoxysilane, methacryloxypropyldimethylmethoxysilane, methacryloxypropylmethyldimethoxysilane, methacryloxypropyltriethoxysilane, methoxymethyltrimethylsilane, 3-methoxypropyltrimethoxysilane, 3-methacryloxypropyldimethylchlorosilane, methacryloxypropylmethyldichlorosilane, methacryloxypropyltrichlorosilane, 3-isocyanatopropyldimethylchlorosilane, 3-isocyanatopropyltriethoxysilane, and bis(3-triethoxysilylpropyl) tetrasulfide. A coupling agent well suited for coupling an activated polymer fiber surface and particulate having on both fiber surface and particulate reactive moieties each independently selected from amine, thiol, alcohol, phenol, azide, acetylene, diene, dienophile, isocyanate, carboxylic acid halide, illustratively include N,N-diglycidyl aniline, N,N-diglycidyl-4-glycidyl oxyaniline, 3,4-epoxycyclohexylmethyl-3,4-epoxycyclohexanecarboxylate, diglycidyl-1,2-cyclohexane dicarboxylate, 2,3-epoxypropyl benzene, exo-2,3-epoxynorbornane, poly(bisphenol A-co-epichlorohydrin) glycidyl end-capped, glycidyl butyrate, glycidyl neodecanoate, glycidyl 4-methoxy phenyl ether, poly(phenylglycidyl ether)-co-formaldehyde, cresyl glycidyl ether, diglycidyl ether of 1,4-butanediol, diglycidyl ether of cyclohexane dimethanol, trimethylol ethane triglycidyl ether, trimethylol propane triglycidyl ether, diglycidyl ether of dibromoneopentyl glycol, polyglycol diepoxide, dimer acid diglycidyl ester, 1,2-epoxy-9-decene, N-(2,3-epoxypropyl) phthalimide, and the reaction products thereof with aminated-acetophenone or its derivatives such as aminated-benzyldimethylketal, aminated-benzophenone or its derivatives such as aminated-Michler's ketone, aminated-benzoin or its derivatives such as aminated-benzoin ethylether.

In instances where the coupling agent has X and Y groups that are both reactive towards the polymer fiber surface, it is appreciated that an intermediate R linear backbone of less than eight carbon atoms provides sufficient steric hindrance so as to disfavor both coupling agent reactive moieties X and Y simultaneously covalently bonding to a polymeric fiber surface at the expense of the ability of the coupling agent to bond with particulate. In instances where an activated polymeric fiber surface has a high surface density of moieties reactive with a coupling agent, a coupling agent having two or three moieties reactive with polymeric fiber surface reactive sites is operative to enhance the rigidity of a particle covalently bonded thereto. Likewise, a multivalent Y moiety serves to covalently bond a particle to a polymeric fiber through multiple sites of attachment. It is appreciated that a coupling agent having multiple X and/or multiple Y moieties are all identical moieties or are each independently a different moiety.

The present invention is further detailed with respect to FIG. 1 that details exemplary steps according to the present invention as a flowchart shown generally at 10. The polymeric fiber surface is activated 12 to create active surface sites reactive with the X moiety of an inventive coupling agent (I). Electron bombardment, flame treatment, heat treatment, and gas phase plasma treatment are all operative herein to impart chemical functionality into a polymeric fiber and thereby activating the same. While activation treatments can occur in vacuum or a variety of atmospheres, preferably, the gaseous atmosphere for the activation is a source of reactants with the polymeric fiber surface to create chemical functionality. An ammonia atmosphere is a particularly preferred atmosphere to functionalize the polymeric fiber surface with reactive primary amine groups. The activated fiber surface is then exposed to a liquid solution containing the coupling agent (I) at step 14. The polymeric fiber either in the form of a thread, a fabric, a mat, or slurry of fibers after exposure to the liquid solution of coupling agent (I) is allowed to dry so as to evaporate coupling agent solvent. The polymer fiber coated with the coupling agent is then exposed to conditions sufficient to allow reaction between polymeric fiber surface and an X moiety of coupling agent (I) 16. Typical conditions for reaction to create a covalent bond between the X moiety of the coupling agent I and the activated polymeric fiber surface illustratively include heating between 25 and 120° Celsius through radiant, convection, microwave, or infrared heating. Thereafter, the polymeric fiber bonded to the coupling agent (I) is exposed to a liquid particulate solution 18. After the polymeric fiber in the form of a thread, fabric, web, or particle slurry has been exposed to the particulate, it is dried to evaporate the particulate solution solvent. The particulate in contact with the coupling agent bonded polymeric fiber surface are then allowed to react to form a covalent bond therebetween 20. While it is appreciated that the reaction conditions for the formation of a covalent bond between the Y moiety of the coupling agent (I) and a particle are dependent on the nature of the reactive moieties involved, typically the reaction conditions are those detailed above with respect to step 16. Optionally, the polymer fiber having particulate covalently bonded thereto through the coupling agent I is exposed to an additional reactant having at least one moiety Y as defined with respect to the coupling agent (I) at step 22 so as to add further covalent bonds to the particulate. The reagent containing moiety Y covalently bonds to the particulate with the remainder of the reagent modifying the surface characteristics of the particulate coated fiber with respect to hydrophobicity, charge density, and reactivity. The reagent bonded to the particulate at step 22 occurs through providing reaction conditions sufficient for a reaction to occur between the Y moiety of the reagent and the particulate occurring at step 24. Typically, reaction occurs under conditions such as those detailed above with respect to step 16. It is appreciated that the reagent in addition to containing a moiety Y preferably contains an additional moiety to which a variety of other substances can be bonded. These particulate bonding substances illustratively include a resin matrix, another type of particle relative to the particle covalently bonded to the polymeric fiber, a second polymeric fiber, a dye molecule, and an electrical connector. Subsequent processing and handling of the fiber then continues in a manner consistent with a conventional polymeric fiber.

Figure 2:
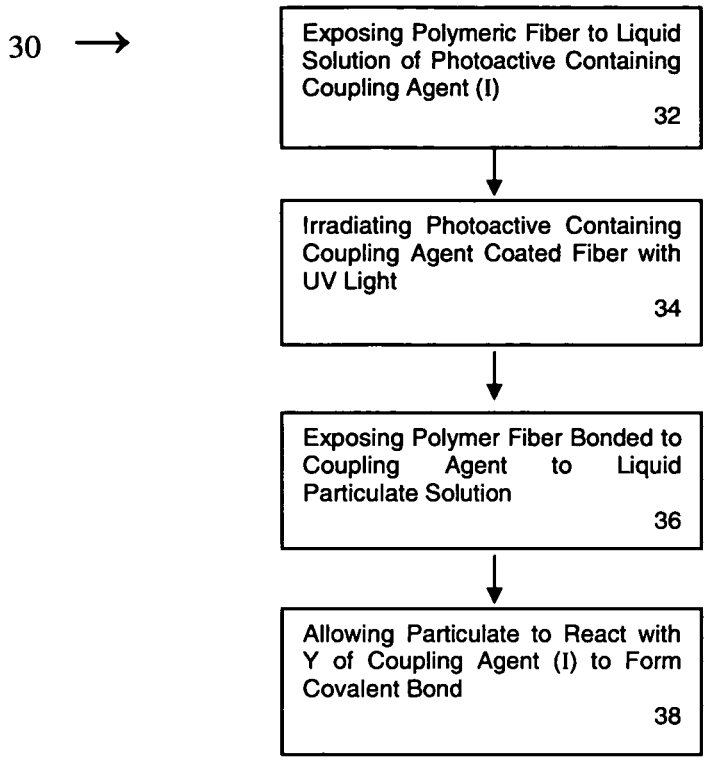
FIG. 2 is a flowchart of a representative process for preparing an inventive article through photonic activation of a synthetic polymeric fiber.

FIG. 2 is a flowchart depicting the steps of polymeric surface activation and coupling agent bonding with UV irradiation shown generally at 30. A conventional polymeric fiber is exposed to a liquid solution and inventive coupling agent containing a photosensitizer moiety. The photosensitizer moieties operative herein are readily synthesized by the reaction of an epoxide moiety with an aminated photosensitizer. It is appreciated that other photosensitizer reactants and reaction schemes are suitable for forming an inventive photoactive coupling agent. Recently reported scientific literature has shown a similar system for surface modification using photoactive silane coupling agents (Jeyaprakash, J. D.; Samuel, S.; Rühe, J. *Langmuir,* 2004, 20, 10080-10085). The precedent for surface modification of polymer surfaces via the irradiation of phenyl-ketone moieties is likewise well known (U.S. Pat. Nos. 6,603,040; 6,623,786). Subsequent to exposing the polymeric fiber to the photosensitizer containing coupling agent 32, the polymeric fiber is exposed to UV irradiation for a time interval sufficient to induce reaction therebetween 34. Typical UV irradiation times range from milliseconds to 15 minutes. It is appreciated that a polymeric fiber woven into an opaque fabric will require irradiation on both sides of such a fabric to induce reaction on both sides. Optionally, an asymmetric fabric is produced where particulate is covalently bonded asymmetrically on a single surface of a fabric. Additionally, following asymmetric addition of particulate to a single side of such a fabric, the second side of the fabric is likewise treated by steps 32 and 34 to optionally add a different type of particulate coating to the opposing surface of the fabric. Such asymmetric particulate coated fabrics find particular applications in the joinder of incompatible or non-adherent resins.

Regardless of the specifics of UV irradiation, thereafter, the polymeric fiber now covalently bonded through the photosensitizer moiety to the coupling agent is then exposed to a liquid particulate solution 36. The particulate is allowed to react with the Y moiety of the coupling agent (I) to form a covalent bond there between 38. The conditions for reaction between a particle and a Y moiety of an inventive coupling agent (I) while depending on the nature of the covalent bond to be formed typically includes those conditions described with respect to step 20 of FIG. 1.

In instances where the polymeric fiber is part of a fabric requiring exposure on each side of the fabric to initiate coupling agent bonding to the fiber, it is appreciated that steps 34-38 can be repeated on the second side of the fabric to covalently bond the same or a different particulate on opposing sides of the fabric. Following covalent bonding of particulate to the polymeric fiber via the coupling agent, the fiber is handled and processed in a conventional manner.

The following examples are provided for the purpose of illustrating various embodiments of the invention and are not meant to limit the present invention in any fashion.

Example 1

Style 706 scoured KM-2 woven para-phenylene polyamide (KEVLAR®) fabric is obtained which has been treated with plasma in order to deposit amine functional groups on the surface of the fiber. A 54 inch wide roll style 706 scoured KM-2 woven KEVLAR® fabric is placed in a continuous plasma reactor discharge device, such as a 4th State, Inc. Plasma Science PS 1010. Typically, the fabric is plasma treated using reactive (oxygen, ammonia) and non-reactive (helium, argon) gaseous discharges to both clean and chemically activate the surface of the KEVLAR®. Typical process parameters for such treatments are a pressure of 500 mTorr of gas, operated at an approximate power output of 350 Watts, and residence times within the plasma of 1 to several minutes. The swatch is removed and analyzed. Standard KEVLAR® contains about 0.6% nitrogen at the fiber surface, via x-ray photoelectron spectroscopy (XPS). The treated fabrics contain 4.63% (Sample 1), 4.07% (Sample 2), 9.79% (Sample 3) nitrogen.

Example 2

The fibers treated in Example 1 are functionalized with silane coupling agent in this example prior to treatment with the colloidal silica. Colloidal silica is obtained from Aldrich Chemical as a dispersion in water (34% wt/wt). A solution of 437.4 mL methanol (ρ=0.791) and 3.6 mL 3-glycidoxypropyltrimethoxy silane (GPS) (ρ=1.070) is prepared and stirred to homogenize the solution (net concentration 1.1% wt/wt, 8.8 mg/mL GPS). Then a swatch of KEVLAR® is dipped into the solution for 60 seconds, after which the swatch is removed and allowed to air dry for 60 seconds. Then the swatch is placed into a polypropylene beaker and placed into an oven at 70° C. for 90 minutes. The samples are removed from the oven and then allowed to cool to room temperature.

While the samples are drying in the oven, a solution of colloidal silica is prepared. To a polypropylene beaker is added 260 mL of a 90:10 ethanol/water solution, prepared with acetic acid to provide a pH level of 4.5. Then 7.9 mL (π=1.230, 34% wt/wt silica) of the colloidal silica is added (net concentration 12.3 mg/mL silica). The swatches of KEVLAR® are placed in the bottom of small polypropylene beakers and 50 mL of the colloidal silica solution is poured over the swatch. Then a second beaker is placed over the KEVLAR® and solution, and the succeeding swatch is placed into that beaker, followed by an additional 50 mL of colloidal silica solution. The nested beakers therefore maintain the KEVLAR® in contact with the solution while keeping it compressed to minimize the required solution. The swatches are incubated in the oven at 70° C. for 5 minutes, after which the swatches are removed and allowed to air dry. Then the swatches are placed back in the oven for 60 minutes to continue the condensation of the colloidal silica upon the GPS-treated fibers. Then the swatches are removed and are evaluated by a variety of methods.

Example 3

Modification of the KEVLAR® fibers is also observed if the colloidal silica solution is used only as a room-temperature dip treatment analogous and subsequent to the GPS treatment. Samples prepared for the stab testing of Example 8 are prepared by dipping swatches into the colloidal silica solution for 60 seconds, followed by drying in air and then curing in the oven at 70° C. for 60 minutes.

Example 4

The procedure of Examples 1-3 is repeated with the substitution of a meta-phenylene polyamide (NOMEX®) for the para-phenylene KEVLAR® in place of KEVLAR® with like results being obtained.

Example 5

Another procedure to functionalize the fibers with particulate that has been treated with epoxy-functional silane coupling agent (GPS) is the addition to a 500 mL 3-neck flask of 330 mL 90:10 ethanol:water solution acidified to a pH of 4.5 using acetic acid. Then 10.0 mL of LUDOX® TMA is added to the solution, providing a net concentration of 12.3 mg/mL in colloidal silica. Then 0.80 mL of GPS is added to the solution over a span of 4 minutes. Net concentration of the GPS is therefore 2.5 mg/mL, and ca. 0.205 g GPS per gram of colloidal silica. The flask is placed in an oil bath, which equilibrated to a temperature of 67° C. The solution is stirred at temperature for 1 hour, at which point the solution is transferred to a polypropylene beaker and cooled to room temperature. Then swatches of KEVLAR® are soaked in the silica/GPS solution for 1 minute, followed by 1 minute of air drying. The swatches are then heated in an oven at 70° C. for 1.5 hour.

Example 6

To gauge the success of fiber modification, the hydrophilicity of the plasma treated fibers of Example 1 are compared with the silane treated swatches from Examples 2 and 5. The contact angles of water with the fiber mats (Example 1) are listed below.

| | Sample # | | |
|---|---|---|---|
| | 1 | 2 | 3 |
| Avg. CA | 80.9° | 90.8° | Wets |

The results correlate well with the observed levels of amine from the XPS data. Recall that the observed nitrogen content of the three samples progressed from 3>1>2, which is the same ordering observed for the contact angle data (progressing from most hydrophilic to least). Water droplets on swatches of Sample 3 are wicked into the weave of the fabric too rapidly to obtain a contact angle. The other samples did not appear to be wetted effectively by the water. In contrast, all of the silica modified swatches (from Examples 2 and 5) exhibited good wetting characteristics, with water being wicked into the weave of the fabric. The less hydrophilic samples were from Example 5. While the water droplets were absorbed by the weave, they could be observed on the surface of the fabric while they were absorbed. The samples described in Example 2 wetted immediately, as soon as the water droplet came into contact with the surface of the fabric. The increase in hydrophilicity is attributable to the colloidal silica attached to the fiber surface.

Example 7

Figure 3:
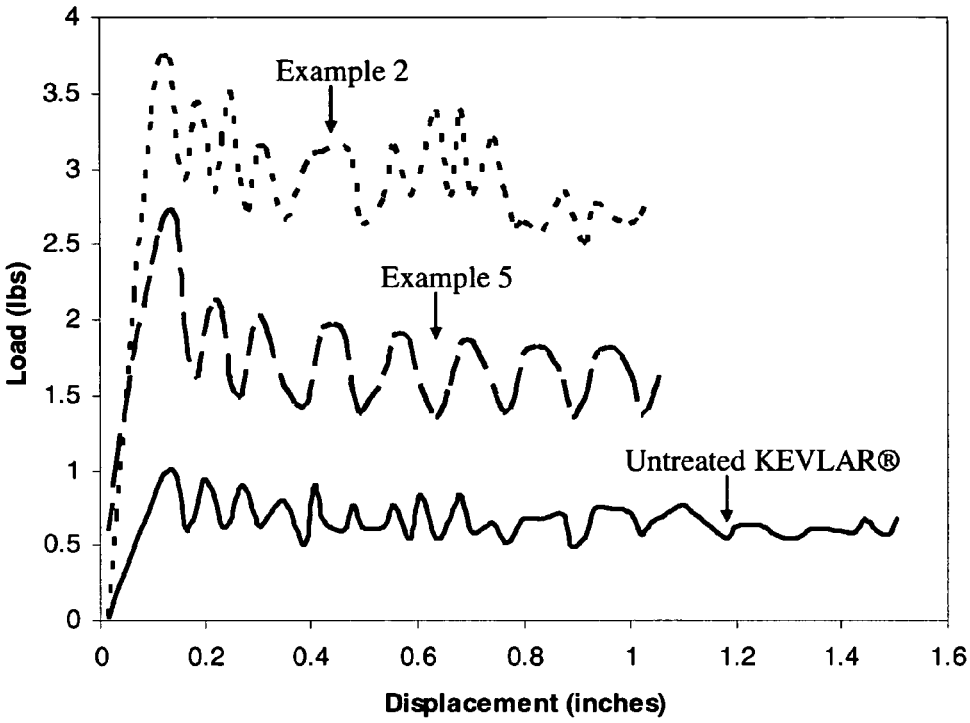
FIG. 3 is a plot illustrating load strength as a function of displacement for an untreated swatch of KEVLAR® (solid line) and swatches treated by the procedures of Example 2 (dotted line) and Example 5 (dashed line).

Roving friction is measured using a custom pullout fixture. This pullout fixture is basically a rectangular aluminum picture frame that allows a spring loaded adjustable lateral tension force to be applied to a woven fabric while a single roving is pulled in tension. Typically, the woven fabric is cut to allow extra roving material at the bottom of the sample, which keeps the cross-roving contact area and frictional measurement constant during the test. The roving pullout fixture is mounted in an Instron model 4505 electro-mechanical testing system equipped with an 89 kN load cell. The crosshead rate during testing is set to 1.27 mm/min. The lateral cross tension of the pullout fixture is adjusted to a force of approximately 445 N. Tensile strength measurements of the warp and fill rovings are also completed using the Instron machine at a crosshead rate of 1.27 mm/min and a gauge length of approximately 25.4 mm. The load strength as a function of displacement is shown in FIG. 3 for an untreated swatch of KEVLAR® (solid line) that is compared with swatches treated by the procedures of Example 2 (dotted line) and Example 5 (dashed line).

Example 8

To test the resistance of the modified fiber to a stabbing assault, 5"×5" swatches of plasma treated KEVLAR® are treated according to Example 3. The swatches are dried for 1.5 hours at 70° C., and are then sandwiched together and placed into a plastic sample bag. Stab resistance is qualitatively probed using a foam block and an ice pick. For traditional KEVLAR®, a 4 ply thickness is easily penetrated with minimal force from a thin penetrator like an ice pick. The 4 ply thickness of the treated swatches is much more resistant to penetration from the ice pick.

Example 9

To test the ballistic resistance of the modified fiber, 15"×15" swatches of plasma treated KEVLAR® are treated according to Example 3. The swatches are dried for 1.5 hours at 70° C., and are then stacked together and stapled to a wooden picture frame. The stacked and stapled swatches of modified fiber are then impacted with steel Fragment Simulator Projectiles (FSPs), which weigh 1.1 g and have a diameter of 5.59 mm (0.220 inches), using a helium charged gas gun. The FSPs are fired at the stacked KEVLAR® fabric at a fixed impact velocity of either 800 or 1200 feet per second (fps). A total of 9 FSP shots are fired into the stacked KEVLAR® fiber target and the number of partial or complete penetrations is recorded as a function of number of layers of KEVLAR® fabric in the target stack (aerial density). The KEVLAR® fiber fabric prepared by Example 3 always outperformed the untreated KEVLAR® control as the percent of FSPs penetrated for Example 3 was always lower at a fixed number of fabric layers.

| Sample | Velocity (fps) | Number of Layers of Fabric | Areal Density ($g/cm^2$) | Percent Penetrated |
|---|---|---|---|---|
| KEVLAR ® control | 800 | 2 | 0.036 | 100 |
| KEVLAR ® control | 800 | 3 | 0.054 | 44.4 |
| KEVLAR ® control | 800 | 4 | 0.072 | 22.2 |
| Example 3 | 800 | 2 | 0.036 | 88.9 |
| Example 3 | 800 | 3 | 0.054 | 11.1 |
| KEVLAR ® control | 1200 | 6 | 0.108 | 88.9 |
| KEVLAR ® control | 1200 | 9 | 0.162 | 66.7 |
| KEVLAR ® control | 1200 | 10 | 0.180 | 55.6 |
| KEVLAR ® control | 1200 | 11 | 0.198 | 11.1 |
| Example 3 | 1200 | 7 | 0.126 | 77.8 |
| Example 3 | 1200 | 9 | 0.162 | 11.1 |

Example 10

To 40 mL screw top vials is added GPS (2.36 g, 10 mmol) and the appropriate amino-phenone. The 4'-aminoacetophenone (1.35 g, 10 mmol) is added to one vial, and formed a light yellow solution in the GPS. 4-aminobenzophenone (1.97, 10 mmol) formed a darker orange solution with a significant amount of insoluble crystals. The contents of both vials became homogeneous after the vials are placed into an oil bath at 160° C. The solutions are stirred for 4 hours with magnetic stirring, after which the vials are removed from the baths and the stir bars are removed. Analysis with thin layer chromatography indicated some residual starting material as well as some peaks for reaction products. The starting materials eluted on the plates more rapidly than the reaction products. The phenone compound could be observed on the TLC plate using illumination with 254 nm light. Unreacted GPS is detected by staining the TLC plate with $KMnO_4$.

The viscous oils obtained from the reaction are diluted with $CHCl_3$ and loaded onto short columns of dry silica gel. The silica is then eluted with several portions of $CHCl_3$. A rapidly eluted band of color is observed for both samples. After the impurity is isolated and discarded (250 mL of solvent), the remaining material is eluted with a mixture of 9:1 $CHCl_3$:MeOH (ca. 400 mL). The second isolated fraction is reduced in volume and transferred to a tared vial, which was then dried in a vacuum oven (ca. 60° C., ca. 4 psi). Some entrapped solvent remained, but both samples formed viscous oils after drying.

Example 11

Solutions are prepared containing ca. 4.25 mg/mL of the photoactive silane coupling compound (PSCC). Both the acetophenone PSCC and the benzophenone PSCC are prepared at similar concentrations in THF. A series of samples is prepared by soaking a piece of nylon-6,6 fabric in the PSCC solution for 1 minute. The fabric is then air dried for 3 minutes. The samples are then exposed to UV irradiation for a specified time interval. The individual samples are irradiated for 1 minute, 2 minutes, or 4 minutes per side, with each sample requiring two exposures to allow reaction of the PSCC on both sides of the fabric.

Following irradiation, each sample is dip-coated for 1 minute in a solution containing 1 wt % colloidal silica in 90:10 EtOH:$H_2O$ (pH=4.5 w/acetic acid). After air-drying for 3 minutes, the nylon fabric samples are dried in an oven at 70° C. for 1.5 hours.

Example 12

The nylon fabric samples prepared by Example 11 are folded into quarters and placed onto a thick foam mat. A sample of standard nylon is also folded in the same manner. Then, an ice pick is used to penetrate the standard nylon near the center of the sample. In a similar fashion the samples treated nylon are also challenged. The samples treated in Example 11 show increased resistance to penetration by the ice pick.

Example 13

The procedure of Example 11 is repeated with polypropylene fabric in place of nylon-6,6 and colloidal titania in place of silica. The resulting swatch upon exposure to UV light for 30 minutes catalyzed the degradation of an aerosol of dioxin coated onto the swatch.

Patent documents and publications mentioned in the specification are indicative of the levels of those skilled in the art to which the invention pertains. These documents and publications are incorporated herein by reference to the same extent as if each individual document or publication was specifically and individually incorporated herein by reference.

The foregoing description is illustrative of particular embodiments of the invention, but is not meant to be a limitation upon the practice thereof. The following claims, including all equivalents thereof, are intended to define the scope of the invention.

The invention claimed is:

1. An article comprising a fabric having increased resistance to puncture wherein the fabric comprises:

a plurality of polymeric fibers, wherein said fibers have in a native state a number of native surface reactive moieties, said fibers being activated to have a plurality of surface activated reactive moieties, said plurality of surface activated reactive moieties being greater than the number of native surface reactive moieties;

a plurality of particles comprising particles having a size ranging from 2 to 1000 nanometers linear dimension along the long axis of the particle; and at least one coupling agent intermediate between a particle and a fiber, said coupling agent forming a first covalent bond to one of said plurality of surface activated reactive moieties and a second covalent bond to said particles to covalently bond a plurality of particles to a fiber, wherein the plurality of particles that are covalently bound to the fibers of the fabric impart to the fabric increased resistance to puncture.

2. The article of claim 1 wherein said polymeric fiber is selected from a group consisting of: polyamides, polyolefins, polyesters, block copolymers, styrene butadiene copolymers, mixed olefin copolymers, polycarbonates, polystyrene, fluoropolymers, polyvinyls, polyurethanes, polysiloxanes; polycarbonate/polydimethyl siloxane copolymers, poly p(-phenylenebenzobisoxazole), carbon fibers, include silk, cellulose, wool, cotton, linen, hemp, ramie, and jute.

3. The article of claim 1 wherein said polymeric fiber is a polyamide.

4. The article of claim 1 wherein said plurality of surface activated reactive moieties comprise a heteroatom selected from the group consisting of: nitrogen, sulfur, oxygen and chlorine, iodine, bromine, or fluorine.

5. The article of claim 1 wherein the plurality of surface activated reactive moieties are chemically distinct from the number of native surface reactive moieties.

6. The article of claim 1 wherein the plurality of surface activated reactive moieties comprise amine groups.

7. The article of claim 1 wherein said particle has catalytic activity.

8. The article of claim 1 wherein the particles comprise silica.

9. The article of claim 8 wherein the plurality of particles asymmetrically coat said fiber about a fiber diameter.

10. The article of claim 8 wherein the plurality of particles are selected from the group consisting of: colloidal silica; silica alumina; silica magnesia; magnesium silicate; magnetic cobalt containing alloys; magnetic niobium containing alloys; metal-oxides, -sulfides, -carbides, -nitrides, -arsenides, -phosphides, silicon; nanolatex; epoxidized rubber, polystyrene nanospheres, barium strontium titanate (Ba,Sr) $TiO_3$, and combinations thereof.

11. The article of claim 8 wherein the plurality of particles comprises colloidal silica.

12. The article of claim 1 further comprising a reagent covalently bonded to said particle.

13. The article of claim 1 wherein said coupling agent has the formula:

$$(X)_m—R—(Y)_n \quad (I)$$

where X is independently in each occurrence a moiety reactive with an activated polymeric fiber surface

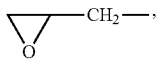

$NHR^1$—, HS—, HO—, $R^2OOC$—, $C(R^1)_2{=}CR^1$—, $R^1C{=}CH—HC{=}CR^2$, OCN—, XOC— (X=Cl, Br, I), $R^1{\equiv}C$—, $N_3$—,

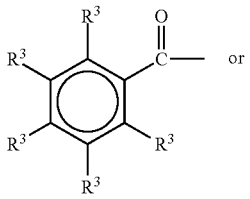

or

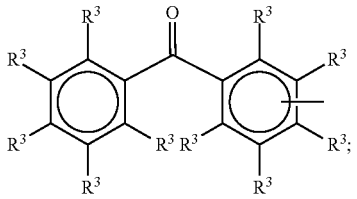

m is an integer 1, 2 or 3; $R^1$ is independently in each occurrence hydrogen or $C_1$-$C_4$ alkyl; $R^2$ is an electron, hydrogen, $C_1$-$C_4$ alkyl; $R^3$ is independently in each occurrence hydrogen; $C_0$-$C_4$ alkyl having a substituent from the group sulfonate, carboxyl, hydroxyl, amine, $C_1$-$C_4$ substituted amine, and quaternary amine; $C_6$-$C_{12}$ aryl; $C_7$-$C_{14}$ aralkyl; and two adjacent $R^3$ substituents combined to form a six-member ring joined to a base phenonyl group, the combined adjacent $R^3$ substituents having at least three cycloalkyl or aryl carbons and a fourth ring forming carbon, oxygen, sulfur or nitrogen atom or $NR^1$ group; R is a linear backbone of a $C_2$-$C_{24}$ alkyl, $C_6$-$C_{24}$ aryl, $C_6$-$C_{24}$ cycloalkyl, ethers-, esters-, thioethers- and amides- of $C_2$-$C_{24}$ alkyl, and solubility enhancing substituent of $R^4$ where the substituents is sulfonyl; Y is $SiR_{3-p}{}^5—(OR^5)_p$, chlorosilyl, or X with the proviso that when Y is independently in each occurrence X, R is less than eight linear carbon atoms in the backbone to the nearest X; p is an integer 1, 2 or 3; $R^5$ is independently in each occurrence hydrogen and $C_1$-$C_4$ alkyl with the proviso that $R^5$ is not in all occurrences hydrogen; and m is an integer 1, 2 or 3; $R^5$ is independently in each occurrence hydrogen and $C_1$-$C_4$ alkyl with the proviso that $R^5$ is not in all occurrences hydrogen; and m is an integer 1, 2 or 3.

14. The article of claim 13 where m is 1 and n is 1.

15. The article of claim 14 where X is $NHR^1$—, HS—$R^2OOC$—, and $C(R^1)_2{=}CR^1$—.

16. The article of claim 15 where $R^3$ in every occurrence is hydrogen and Y is

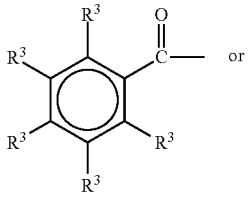

or

-continued

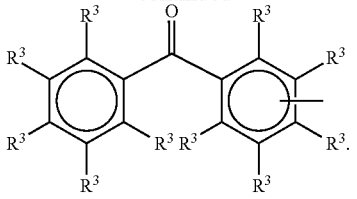

17. The article of claim 14 where both X and Y are

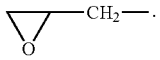

18. The article of claim 13 where Y in every occurrence is $Si—R^5_{3-p}(OR^5)_p$.

19. The article of claim 1 wherein said coupling agent is a silane.

20. The article of claim 1 wherein said particle has a linear dimension along the long axis of the particle ranging from 4 to 100 nanometers.

21. The article of claim 1 wherein said article is a woven article.

22. The article of claim 1 wherein said article is a woven article and said polymeric fiber is a polyamide selected from the group consisting of aromatic polyamides.

23. The article of claim 22 wherein said polyamide is a para-phenylene polyamide.

24. The article of claim 22 wherein said polyamide is a meta-phenylene polyamide.

25. The article of claim 1 wherein said coupling agent is 3-glycidoxypropyltrimethoxy silane.

26. An article comprising:

a plurality of polymeric fibers having an exterior surface that is modified with particulate in order to enhance resistance to puncture, wherein a portion the exterior surface of the fiber is covalently bonded to at least one intermediate coupling agent, said at least one intermediate coupling agent being at least bifunctional and having at least one functional group on at least one end of said intermediate coupling agent wherein the at least one first functional group forms a covalent bond between the coupling agent and a portion of the exterior surface of the fiber and at least one other functional group on at least one other end of said intermediate coupling agent wherein the at least one other functional group forms a covalent bond between the coupling agent and a particle, thereby forming fibers with a surface that is covalently bonded to a particulate through an intermediate coupling agent and at least one covalent bond and at least one other covalent bond thereby increasing the plurality of fibers' resistance to puncture.

27. An article comprising a fabric having increased resistance to puncture wherein the fabric comprises:

a plurality of polymeric fibers selected from the group consisting of aromatic polyamides and other ballistic fibers, wherein said fibers have a plurality of inorganic particles selected from the group consisting of silica, silicates, and metal oxides covalently coupled to said fibers via a coupling agent, said inorganic particles having a size ranging from 2 to 1000 nanometers linear dimension along the long axis of the particle, wherein the plurality of particles that are covalently bound to the fibers of the fabric impart to the fabric increased resistance to puncture.

28. The article of claim 27 wherein the coupling agent is an alkoxy silane.

29. The article of claim 27 wherein the coupling agent is 3-glycidoxypropyltrimethoxy silane.

30. The article of claim 27 wherein the fibers are woven para-phenylene polyamide fibers.

* * * * *